United States Patent [19]

Krause et al.

[11] Patent Number: 4,890,467

[45] Date of Patent: Jan. 2, 1990

[54] SWITCH LOCK

[76] Inventors: Barry Krause, 178 Ni River Dr., Spotsylvania, Va. 22553; Eric M. Fredrickson, 113 Highland St., Taunton, Mass. 02780

[21] Appl. No.: 200,436

[22] Filed: May 31, 1988

[51] Int. Cl.[4] ..... E05B 29/00; H01H 19/58

[52] U.S. Cl. ..... 70/369; 70/377; 200/8 R; 200/11 R; 200/11 J; 200/43.08

[58] Field of Search ..... 70/237, 239, 367–370, 70/377, DIG. 30, 277, 278; 200/43.08, 43.11, 11 A, 11 C, 11 R, 11 J, 11 K, 8 A, 8 R

[56] References Cited

U.S. PATENT DOCUMENTS

| | | | |
|---|---|---|---|
| 1,805,891 | 5/1931 | Shinn | 70/369 |
| 1,922,889 | 8/1933 | Falk | 70/368 |
| 1,987,735 | 1/1935 | Falk | 70/377 X |
| 1,990,934 | 2/1935 | Falk | 70/377 X |
| 2,061,456 | 11/1936 | Falk | 70/369 |
| 2,460,709 | 2/1949 | Navarro | 70/369 |
| 3,321,589 | 5/1967 | Persia et al. | 200/43.08 |
| 3,530,697 | 9/1970 | Warnod | 70/368 |
| 3,742,161 | 6/1973 | Lipschutz | 200/8 R X |
| 4,398,405 | 8/1983 | Patriquin | 70/369 |
| 4,416,129 | 11/1983 | Thimot | 70/369 |
| 4,558,193 | 12/1985 | Test | 200/43.08 |
| 4,639,562 | 1/1987 | Fredrickson | 200/43.08 |
| 4,672,827 | 6/1987 | Craig | 70/367 |
| 4,715,201 | 12/1987 | Craig | 70/369 |

FOREIGN PATENT DOCUMENTS

| | | | |
|---|---|---|---|
| 0066052 | 4/1982 | Japan | 70/237 |

*Primary Examiner*—Gary L. Smith
*Assistant Examiner*—Douglas E. Ringel

[57] ABSTRACT

This invention is directed at a lock actuated switch which has a housing and a lock cylinder. The housing includes a terminal housing portion and a support portion. The support portion has a wall that defines a longitudinal bore and that has an inner surface with V shaped notches formed therein. The V shaped notches may be formed by three triangular surfaces which meet at their apices. The longitudinal bore extends through the terminal housing portion and the wall has means of retaining a series of fixed contacts that have arced terminal ends. The lock cylinder includes a terminal end, a longitudinal second bore and a body portion. Tumbler slots are formed in the body portion in spaced relation to each other. One of the tumbler slots has a spring loaded detent tumbler mounted therein. As the lock cylinder is moved axially into the housing, the detent tumbler rides over one of the V shaped notches compressing the spring until the detent tumbler passes over the V shaped notch and comes to rest.

4 Claims, 6 Drawing Sheets

SWITCH LOCK

BACKGROUND OF THE INVENTION

1. Field of the Invention

This invention relates to switch locks and more specifically to a switch lock having a unitary plastic housing and lock cylinder.

BRIEF DESCRIPTION OF THE DRAWINGS

Further details are explained below with the help of the example(s) illustrated in the attached drawings in which.

SUMMARY OF THE INVENTION

Figure 1:
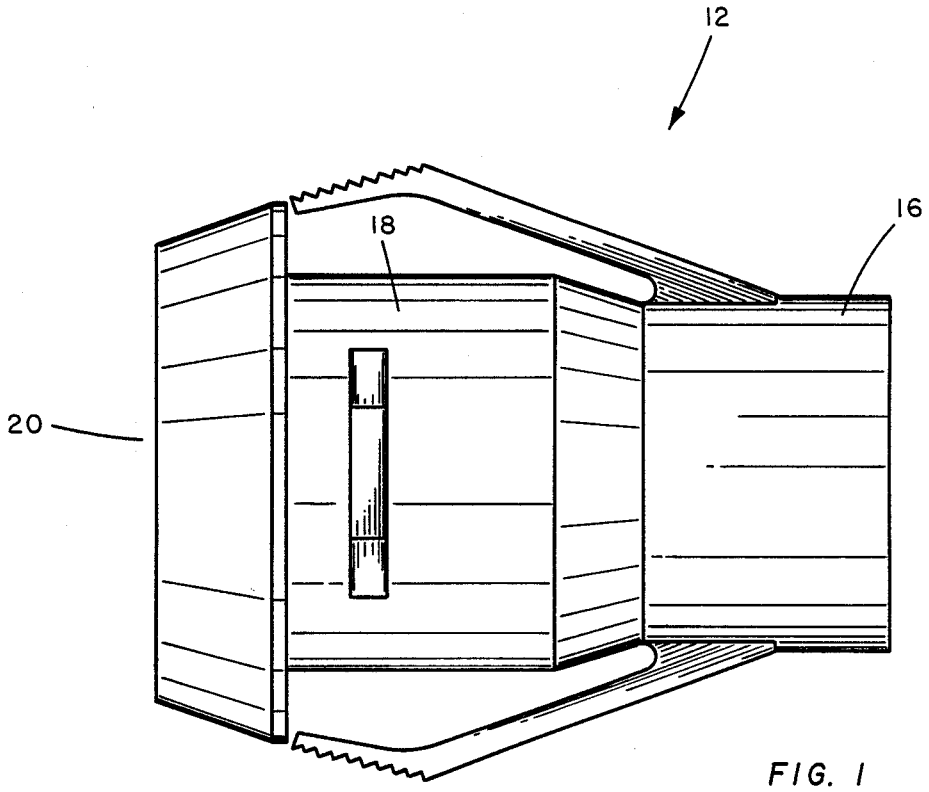
FIG. 1. is a front elevational view of the switch lock according to the present invention.
Figure 2:
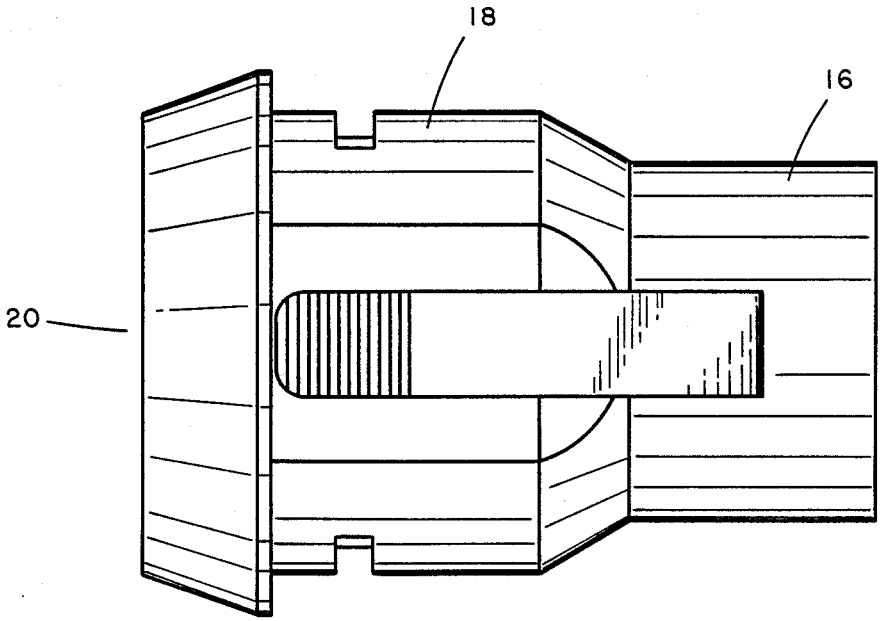
FIG. 2. is a side elevational view of the switch lock shown in 1.
Figure 3:
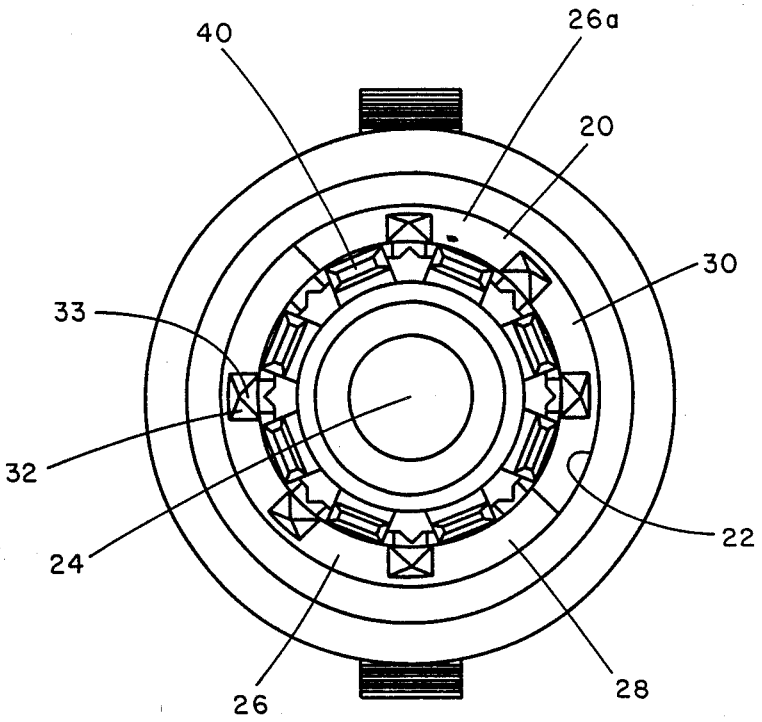
FIG. 3 is a top plan view of the housing of the switch lock shown in FIG. 1.
Figure 4:
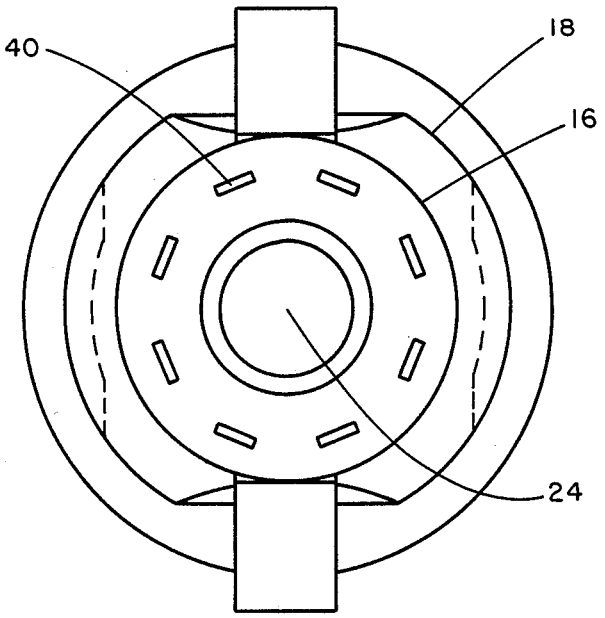
FIG. 4 is a bottom plan view of the housing of the switch lock shown in FIG. 1.
Figure 5:
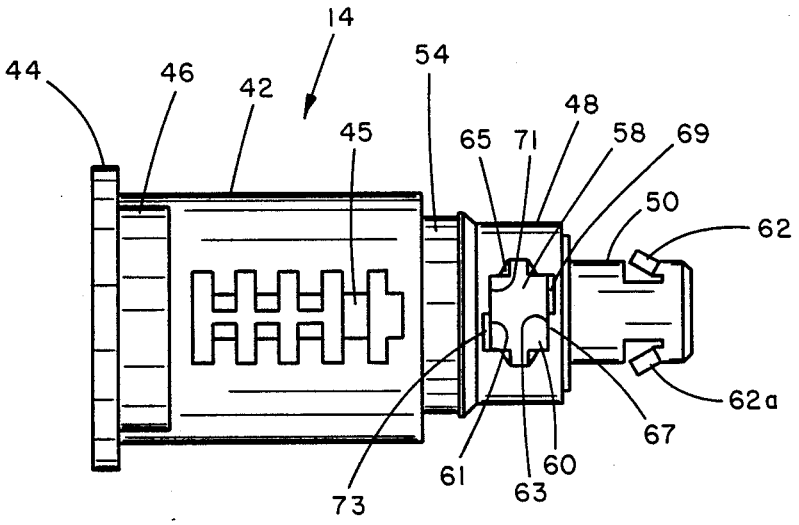
FIG. 5. is a front elevational view of the lock cylinder of the switch lock shown in FIG. 1.
Figure 6:
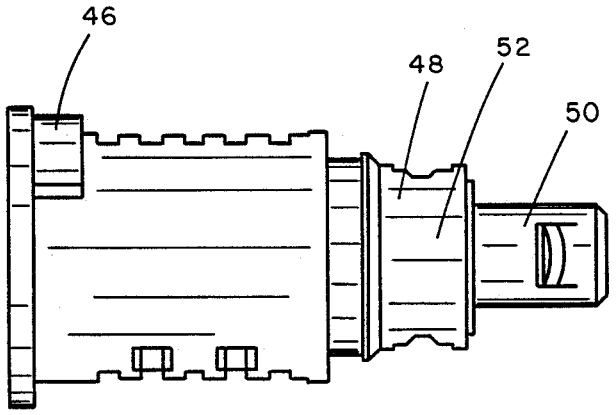
FIG. 6. is a side elevational view of the lock cylinder shown in FIG. 5.
Figure 7:
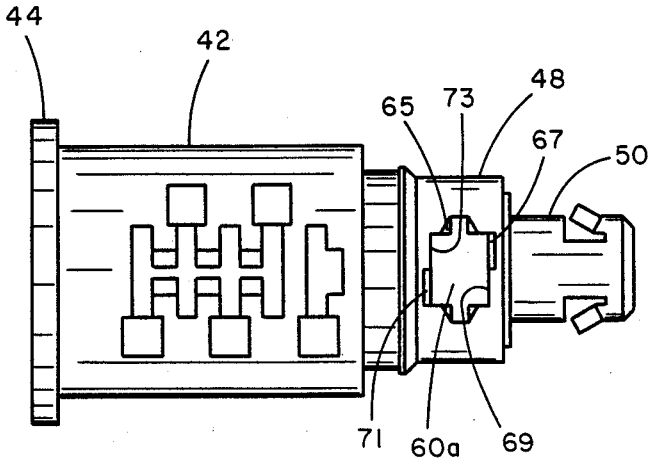
FIG. 7. is a rear elevational view of the lock cylinder shown in FIG. 5.
Figure 8:
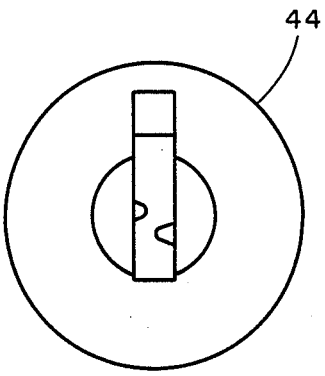
FIG. 8. is a top plan view of the switch lock according to the present invention.
Figure 9:
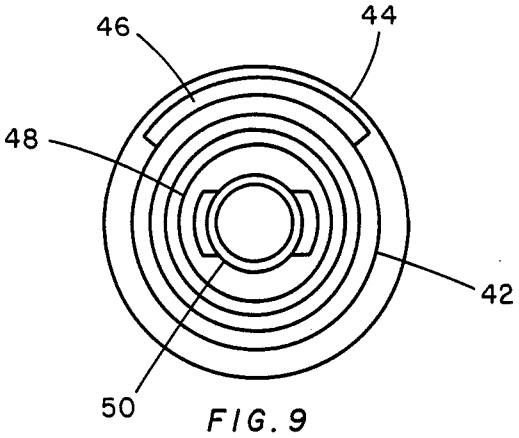
FIG. 9. is a bottom plan view of the switch lock according to the present invention.
Figure 10:
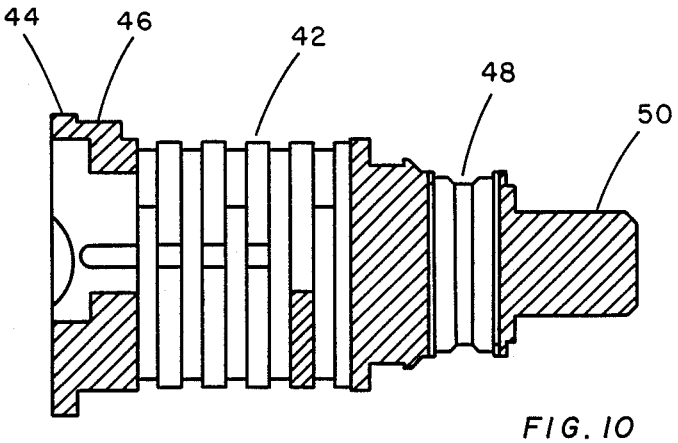
FIG. 10 is a section of the lock cylinder of the switch lock shown in FIG. 5.
Figure 11:
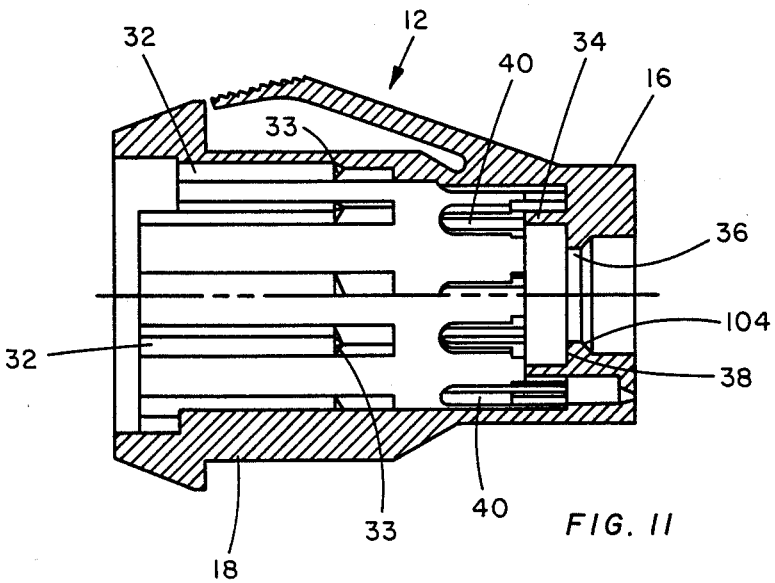
FIG. 11 is a section of the housing of the switch lock shown in FIG. 3.
Figure 12:
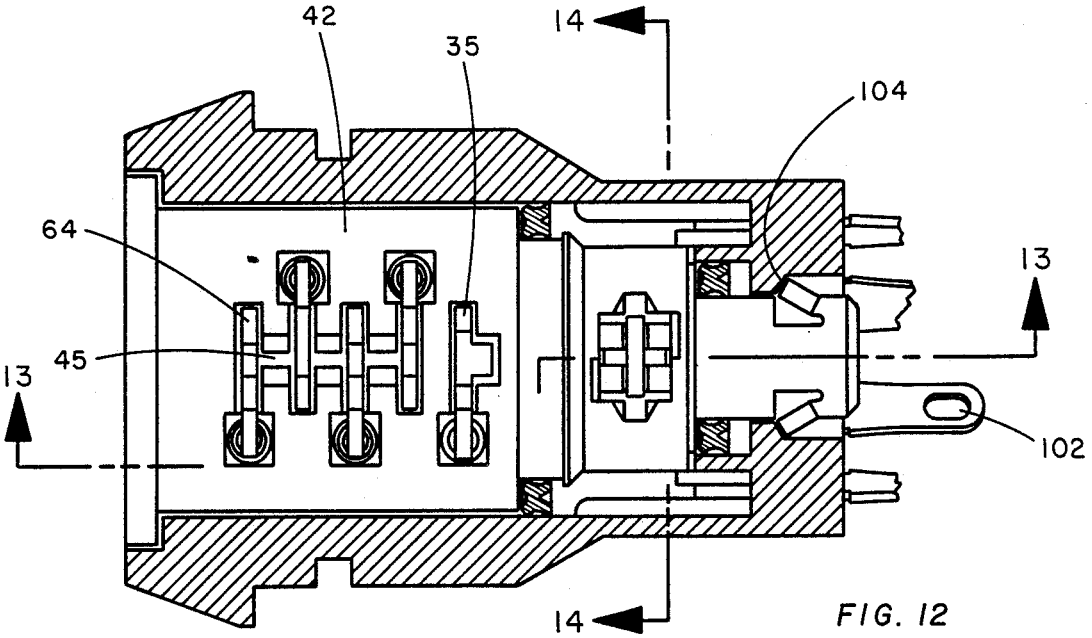
FIG. 12 is a section of the switch lock shown in FIG. 1.
Figure 13:
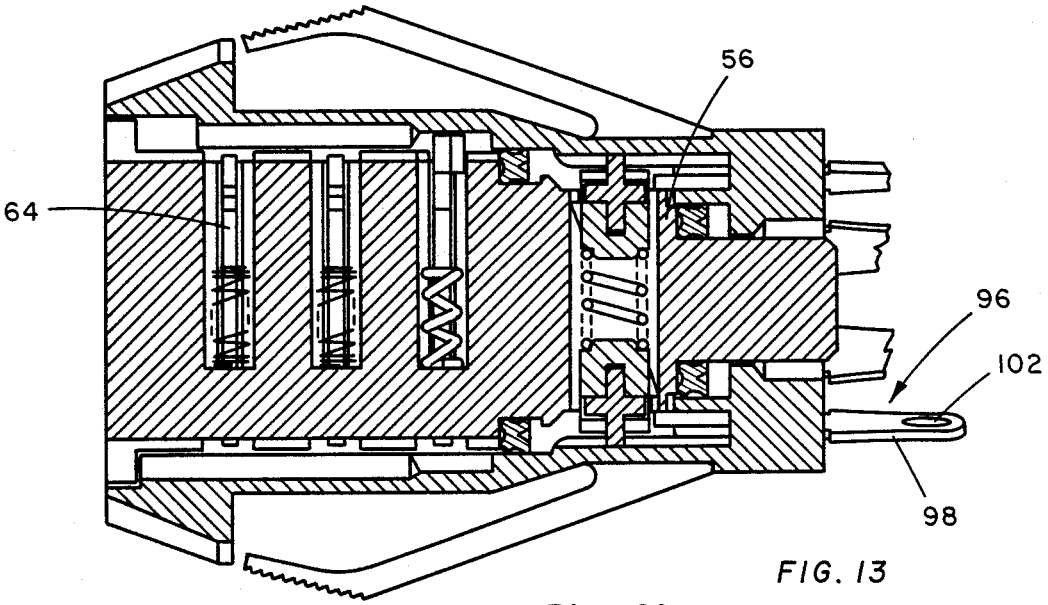
FIG. 13 is a section taken on line 13—13 of FIG. 12 of the switch lock shown in FIG. 1.
Figure 14:
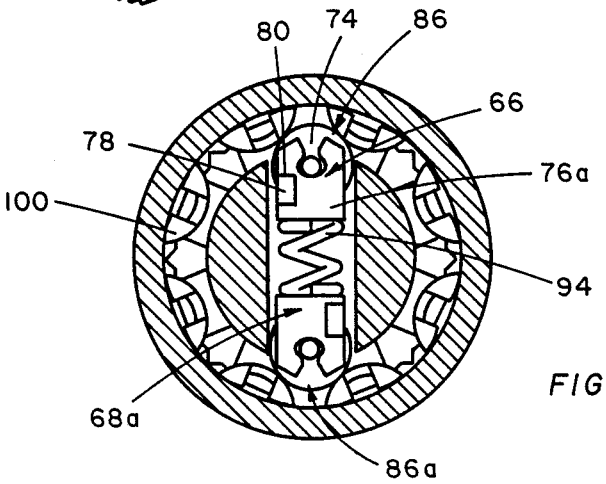
FIG. 14 is a section taken on line 14—14 of FIG. 12 of the switch lock shown in FIG. 1.

The invention is directed at a lock actuated switch comprising a housing and a lock cylinder. The housing includes a terminal housing portion and a support portion with the support portion having a wall defining a longitudinal bore. The wall has an inner surface with V shaped notches formed on the inner surface. Each of the V shaped notches is formed by three triangular surfaces which meet at their apices. The lock cylinder includes tumbler slots formed in its body portion in spaced relation to each other. One of the tumbler slots has a spring loaded detent tumbler mounted therein. During assembly as the lock cylinder is moved axially into the housing, the detent tumbler rides over one of the V shaped notches compressing the spring until the detent tumbler passes over the V shaped notch and comes to rest.

The invention is also directed at a lock actuated switch having its lock cylinder including a body portion, a switch portion and a shaft portion. The switch portion includes a tubular housing portion having a through channel formed therein. The channel is formed in the tubular housing portion opened at one side by a first opening and at the other side by a second opening and having an upper inner surface, a lower inner surface and a pair of side surfaces. The upper and lower inner surfaces are in spaced parallel relation to each other, and the pair of side surfaces are in spaced parallel relation to each other and in right angle relationship with the upper inner and lower inner surfaces. Stop portions extend from the lower inner surface adjacent the first opening, from the lower inner surface adjacent the second opening, from the upper inner surface adjacent the first opening and from the upper inner surface adjacent the second opening. A first contact holder comprises a back which has first and a second side edges. A first arm extends in right angle relation from the first side edge thereof and a second arm extends in right angle relation from the second side edge. Each of the arms includes an open key hole slot. Each of the arms has an external surface which includes an integral ramp portion positioned thereon. The ramp portion of the first arm terminates at an end by a first stop remote from the back. The ramp portion of the second arm terminates at an end by a second stop remote from the back. A first movable contact is movably mounted in the first contact holder, and the housing has fixed contacts. The first movable contact is engaged to the fixed contacts. A second contact holder of similar construction to the first contact holder has a second movable contact mounted therein. The assembly of the first contact holder and first movable contact is positioned within the channel of the switch portion with the first stop of the ramp portion abutting the fourth stop portion of the upper inner surface, the second stop of the ramp portion abutting the second stop portion of the lower inner surface and a portion of the first movable contact extending through the second opening. A helical spring having a first terminal end and a second terminal end is positioned within the cavity of the switch portion with the first terminal end bearing against the back of the first contact holder and the second terminal end bearing against the back of the second contact holder. The assembly of the second contact holder and second movable contact is positioned within the cavity of the switch portion with the first stop bearing against the third stop portion and the second stop abutting the first stop portion of the lower inner surface and a portion of the second movable contact extending through the first opening. The first and second movable contacts engage the fixed terminals.

DESCRIPTION OF THE PREFERRED EMBODIMENT(S)

There is shown in the drawings a switch lock 10 comprising a housing 12 and a lock cylinder 14. The housing 12 and the lock cylinder 14 are of unitary construction and may be formed of a plastic, nylon for example.

The housing 12 is generally tubular and includes a terminal housing portion 16 and a support portion 18. The support portion 18 has an open terminal end 20 and is in integral coaxial relationship at its other end with the terminal housing portion 16. The support portion 18 has a wall 22 defining a longitudinal bore 24 within which the assembled lock cylinder 14 is positioned. A first land 26 extends inwardly from the inner surface of the wall 22 for the major portion of the internal circumference of the bore 24 and spaced below the open terminal end 20 thereof providing a first primary circumferential surface 28. A second land 26a extends inwardly from inner surface of the wall 22 for a portion of the inner circumference of the bore 24. The second land 26a is positioned on a horizontal plane below that of the first land and provides a second circumferential surface 30. A series of longitudinally extending, comparatively shallow slots 32 are formed in the inner surface of the wall 22 extending from the first and second lands 26, 26a in spaced, parallel relation to each other. Each of the slots 32 merge with a V shaped notch 33. Each of the V shaped notches 33 are formed by three triangular surfaces which meet at their apices. The three triangular surfaces of the V shaped notches 33 provide a lead when positioning the lock cylinder 14 within the housing 12.

The longitudinal bore 24 extends into the terminal housing portion 16 to a base portion 34. The base portion 34 partially closes off the lower terminal end of the terminal housing portion 16. The base portion 34 has a through aperture 36 formed therein. The aperture 36 has a diameter less than the bore 24, opens therein and extends coaxially therefrom. A shoulder 38 is formed by the inner surface of the base portion 34 adjacent the aperture 36. A series of through engagement slots 40 are formed longitudinally, through the base portion 34 adjacent and around the inner surface of the wall of the support portion 18 in spaced relation to each other. The slots 40 are continued as shallow channels in the inner surface of the wall of the longitudinal bore 24.

The lock cylinder 14 comprises a cylindrical body portion 42 having an annular flange 44 extending integrally from proximate a terminal end thereof in right tangle relation thereto. A generally rectangular, integral stop portion 46 extends from the body portion 42 in abutting relation to the flange 44. Through tumbler channels or slots are formed at right angles to a longitudinal second bore 45 which is in coaxial relation with the longitudinal axis of the lock cylinder 14. The tumbler channels are spaced from each other. Each of the tumbler channels has a spring loaded tumbler mounted therein except for the lowest tumbler channel which as a spring loaded detent tumbler 35 mounted therein. The lock cylinder 14 is divided into the body portion 42, a switch portion 48 and a shaft portion 50.

The switch portion 48 is integral with and extends axially from the end of the body portion 42 remote from the flange 44. The switch portion 48 comprises a tubular housing portion 52 having one terminal end closed by a partition 54 and the other end closed by a base 56. The partition 54 separates the cavity or channel 58 defined by the housing 52 from the longitudinal second bore 45. The housing portion 52 has a first opening 60 fabricated through one side thereof and a second opening 60a fabricated through the other side thereof and in opposed relation with the first opening 60. The through channel or cavity 58 formed in the housing portion 52 is opened at each side by either the first opening 60 or the second opening 60a. The channel or cavity 58 has an upper inner surface 61, a lower inner surface 63 and a pair of side surfaces 65. The upper inner surface 61 and lower inner surface 63 are in spaced parallel relation to each other and the pair of side surfaces 65 are in spaced parallel relation to each other and in right angle relationship with the upper inner and lower inner surfaces 61, 63. A rectangular first stop portion 67 extends upward from the "left side" of the lower inner surface 63 adjacent the first opening 60 and a rectangular second stop portion 69 extends upward from the "right side" of the lower inner surface 63 adjacent the second opening 60a. A rectangular third stop portion 71 extends downward from the "right side" of the upper inner surface 61 adjacent the first opening 60 and a rectangular fourth stop portion 73 extends downward from the "left side" of the upper inner surface 61 adjacent the second opening 60a.

The cylindrical shaft portion 50 is integral with and extends axially from the base 56 of the switch portion 48 remote from the flange 44. The cylindrical shaft portion 50 has a first engagement portion 62 extending from one side in close proximately to the terminal end thereof and a second engagement portion 62a extending from the other side thereof and in opposed relation with the first engagement portion 62. A series of tumblers 64 are mounted in the second bore 45 of the body portion 42 extending through the slots formed in the body portion 42.

Figures 15, 15A:
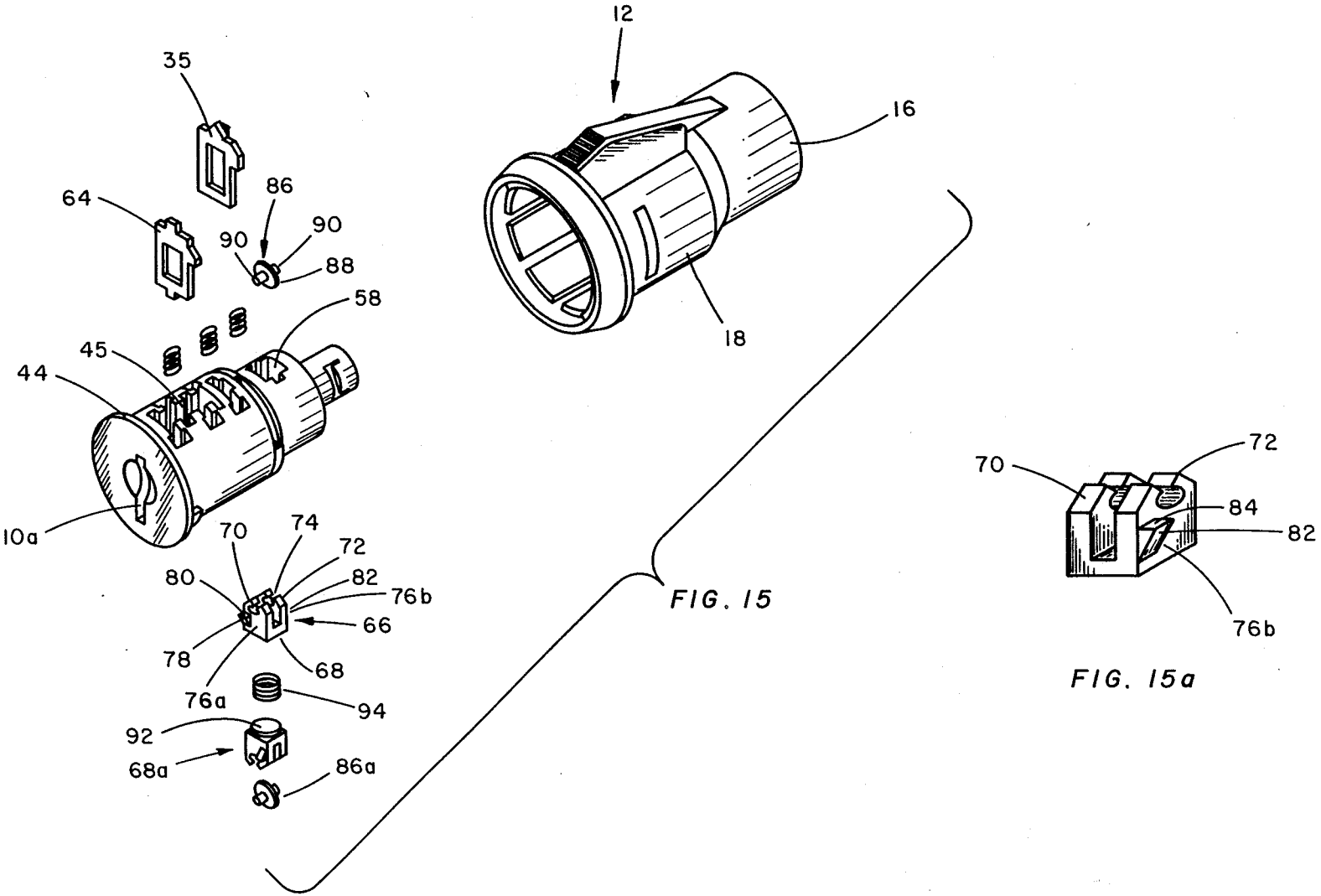
FIG. 15 is an exploded view of the switch lock shown in FIG. 1.
FIG. 15A is a perspective view of the external surface of the second arm 72 of the first contact holder 66.

A plastic first contact holder 66 comprising a back 68 which is generally rectangular in configuration having a first arm 70 extending in right angle relation from one side edge thereof and a second arm 72 extending in right angle relation from the opposing other side edge thereof. Each of the arms 70, 72 includes a key hole slot 74 as shown in FIG. 15 which is open to the area external to that defined by the first contact holder 66 and which has a lead in. The arms 70, 72 are in spaced parallel relation to each other and each of them has an external 76a, 76b. The external surface 76a of the first arm 70 includes an integral wedge shaped ramp portion 78 which is positioned on one side of the external surface 76a. The ramp portion 78 merges into the external surface 76a in close proximity to the back 68 and is terminated at its other end by a first top 80 remote from the back 68. The external surface 76b of the second arm 72 includes an integral wedge shaped ramp portion 82 which is positioned on the side of the external surface 76b. The ramp portion 82 merges into the external surface 76b in close proximity to the back 68 and is terminated at its other end by a second stop 84 remote from the back 68. A disc like movable contact 86 comprises a circular disk 88 having centrally positioned protrusion 90 extending from each side of the disk 88. The movable contact 86 is mounted in the area defined by the back 68, first arm 70 and second arm 72 of the first contact holder 66 by snapping each of the protrusions 90 into a keyhole slot 74 of an arm 70, 72 positioning the disk 88 between the first and second arms 70, 72. The disk 88 of the movable contact 86 can be rotated within the first contact holder 66 and has a portion extending beyond the area defined by the first contact holder 66. A plastic second contact holder 68a is of similar construction to the first contact holder 66 and has a movable contact 86a identically mounted therein. The subassembly of first contact holder 66 and its movable contact 86 is positioned within the cavity 58 of the switch portion 48 by sliding the first contact holder 66 with its movable contact 86 though the first opening 60 until the first stop 80 of the ramp portion 78 butts the fourth stop portion 73 of the upper inner surface 61, the second stop 84 of the ramp portion 82 butts the second stop portion 69 of the lower inner surface 63 and a portion of the movable contact 86 extends through second opening 60a. Each of the backs 68 of the first and second contact holders 66, 68a includes a centrally positioned bulbous extension 92. A helical spring 94 is positioned within the cavity 58 of the switch portion 48 with one of its terminal ends bearing against the back 68 of the first contact holder 66 and circumscribing the bulbous extension 92. The subassembly of the second contact holder 68a and its movable contact 86a is positioned within the cavity 58 of the switch portion 48 by sliding the second contact holder 68a with its back 68 first, though the first opening 60 until the ramp of the ramp portion 78 rides over the third stop portion 71 of the upper inner surface 61, so that the first stop 80 drops behind and bears against the third stop portion 71, simultaneously the ramp of the ramp portion 82 rides over the first stop portion 67 of the lower inner surface 63 so that the second stop 84 drops behind and bears against the first stop portion 67, the second stop 84 of the ramp portion 82 butts the first stop portion 67 of the lower inner surface 63 and a portion of the movable contact 86a extends through first opening 60. When the ramp portion rides over the stop portion the two parts of the first and second arms 70, 72 flex toward each other and then spring back. The other terminal end, of the positioned helical spring, bears against the back of the second contact holder 68a circumscribing the bulbous extension 92.

Fixed terminals 96 comprise a shank portion 98, an arced contact head 100 formed integral with one end of the shank portion 98 and the other end having an integral engagement portion 102 extending longitudinally therefrom. A fixed terminal 96 is positioned in each of the engagement slots 40 of the housing 12 with the contact head 100 placed on a plane slightly below the juncture of the terminal housing portion 16 and the support portion 18 and the engagement portion 102 extending beyond the base portion 34 of the housing 12. The arced surfaces of the contact heads 100 of the fixed terminals 96 act as guides to compress the spring 94 as the movable contacts 86 pass over them.

The subassembly of the housing 12 and the fixed terminals 96 and the subassembly of the lock cylinder 14, the movable contact assembly and the lock tumblers 64 can now be assembled together. The lock cylinder subassembly is placed within the housing sub assembly by passing the shaft portion 50 of the lock cylinder 14 into the longitudinal bore 24 until an annular external shoulder, formed by the smaller external diameter of the switch portion 48 in relation to the body portion 42, butts against the internal shoulder formed in the housing 12 by the smaller internal diameter of the terminal housing portion 16 is relation to the support portion 18. During this process, the arced extension on the detent tumbler 35 rides on the inner surface of the wall of the housing 12 until it passes over the triangular surfaces of one of the notches 33 compressing its spring until it arrives at its final position. Simultaneously the shaft portion 50 is passed through the aperture 36 pressing the first and second engagement portions 62, 62a toward the longitudinal axis of the shaft portion 50 until the first and second engagement portions 62, 62a pass an inwardly extending, annular shelf 104 formed proximate the aperture 36. Once passed the shelf 104 the first and second engagement portions 62, 62a return to their original configuration and their free terminal ends engage against the shelf 104. Another annular external shoulder, formed by the smaller external diameter of the shaft portion 50 in relation to the switch portion 48, is in close proximity to the internal shoulder formed in the terminal housing portion 16 of the housing 12. Seals formed of Buna-N material, for example, are positioned between the internal and external shoulders "above" and "below" the switch portion 48, sealing the switch portion 48 from the outside environment. The assembled switch lock can now be used with a key in a manner well known in the art.

When a correctly coded key is inserted in the key slot 10a, the key tumblers 64 are withdrawn from their resting place, the slot 32, positioning them completely within the cylinder defined by the body portion 42 of the lock cylinder 14. This allows rotation of the lock cylinder 14. As the lock cylinder 14 is rotated, the detent tumbler 35 slides against one surface of the slot 32 compressing the detent tumbler spring 37 and thence slides onto the wall 22. As the rotation continues, the detent tumbler 35 continues to slide along the wall 22 until it slides into an adjacent notch 33 indicating a different lock and switch position.

What we claim is:

1. A lock actuated switch comprising a housing and a lock cylinder, the housing including a terminal housing portion and a support portion, the terminal housing having a lower terminal end, the support portion having an open terminal end and being in integral coaxial relationship at its other end with the terminal housing portion, the support portion having a wall defining a longitudinal bore, the lock cylinder including a body portion, a switch portion and a shaft portion, the switch portion being integral with and extending axially from the body portion, the switch portion including a tubular housing portion, the tubular housing portion having a channel formed therein, the tubular housing portion having sides and having a first opening fabricated through one side thereof and a second opening fabricated through the other side thereof and in opposed relation with the first opening, the channel formed in the tubular housing portion opened at one side by the first opening and at the other side by the second opening, the channel having an upper inner surface, a lower inner surface and a pair of side surfaces, the upper and lower inner surfaces being in spaced parallel relation to each other and the pair of side surfaces being in spaced parallel relation to each other and in right angle relationship with the upper inner and lower inner surfaces a first stop portion extending from the lower inner surface adjacent the first opening and a second stop portion extending from the lower inner surface adjacent the second opening, a rectangular third stop portion extending from the upper inner surface adjacent the first opening and a fourth stop portion extending downward from the upper inner surface adjacent the second opening, a first contact holder comprising a back, the back having a first side edge and a second side edge, a first arm extending in right angle relation from the first side edge thereof and a second arm extending in right angle relation from the second side edge, each of the arms including an open key hole slot, the arms being in spaced parallel relation to each other and each of them having an external surface, the external surface of the first arm including an integral ramp portion positioned on one side thereof, the ramp portion merging therewith in close proximity to the back and terminated at its other end by a first stop remote from the back, the external surface of the second arm including an integral wedge shaped ramp portion positioned on the the external surface, merging into the external surface in close proximity to the back and terminating at its other end by a second stop remote from the back, a first movable contact moveable mounted in the area defined by the back, first arm and second arm of the first contact holder and the housing having fixed contacts, the first moveable contact engaging the fixed contact, a second contact holder of similar construction as the first contact holder and having a second movable contact mounted therein, the second movable contact similar in all respects to the first movable contact, the assembly of first contact holder and first movable contact positioned within the channel of the switch portion with the first stop of the ramp portion abutting the fourth stop portion of the upper inner surface, the second stop of the ramp portion abutting the second stop portion of the lower inner surface and a portion of the first movable contact extending through the second opening, a helical spring having a first terminal end and a second terminal end being positioned within the cavity of the switch portion with first terminal end bearing against the back of the first contact holder and the second terminal end bearing against the back of the second contact holder, the assembly of the second contact holder and second movable contact being positioned within the cavity of the switch portion with the first stop bearing against the third stop portion and the second stop abutting the first stop portion of the lower inner surface and a portion of the second movable contact extending through the first opening, the first and second moveable contact engaging the fixed terminals.

2. The lock actuated switch as set forth in claim 1 wherein each of the backs of the first and second contact holders includes a centrally positioned bulbous extension, the first terminal end of the helical spring circumscribing the bulbous extension of the first contact holder and the second terminal end of the helical spring circumscribing the bulbous extension of the second contact holder.

3. The lock actuated switch as set forth in claim 1 wherein the lock cylinder includes a terminal end and comprises a cylindrical body portion having an annular flange extending integrally from proximate the terminal end thereof in right angle relation thereto, a generally rectangular, integral stop portion extends from the body portion in abutting relation to the flange, the cylindrical shaft portion being integral with and extending axially from the switch portion remote from the flange and the cylindrical shaft portion having a first engagement portion extending from one side in close proximity to the terminal end thereof and a second engagement portion extending from the other side thereof and in opposed relation with the first engagement portion, the terminal housing portion having a shelf formed therein the first and second engagement portions bearing against the shelf when the lock cylinder is engaged with the housing.

4. The lock actuated switch as set forth in claim 1 wherein the first and second movable contact are disc like in configuration and each comprises a circular disk having first and second sides and having a centrally positioned protrusion extending from the first and second sides, the first movable contact being mounted in the area defined by the back, first arm and second arm of the first contact holder by snapping each of the protrusions into the keyhole slot of the first and second arms positioning the disk between the first and second arms, the disk of the first movable contact can be rotated within the first contact holder and has a portion extending beyond the area defined by the first contact holder, the second contact holder being of similar construction to the first contact holder and having the second movable contact identically mounted therein.

* * * * *